US007017200B2

(12) United States Patent
Reppas et al.

(10) Patent No.: US 7,017,200 B2
(45) Date of Patent: Mar. 28, 2006

(54) CONVERTIBLE FURNITURE

(75) Inventors: George S. Reppas, Hillsborough, CA (US); Frederick Stengel, Redwood City, CA (US)

(73) Assignee: OptiSpace International, Inc., Burlingame, CA (US)

( * ) Notice: Subject to any disclaimer, the term of this patent is extended or adjusted under 35 U.S.C. 154(b) by 54 days.

(21) Appl. No.: 10/660,094

(22) Filed: Sep. 11, 2003

(65) Prior Publication Data

US 2005/0055770 A1 Mar. 17, 2005

(51) Int. Cl.
*A47C 17/40* (2006.01)

(52) U.S. Cl. ..... 5/2.1; 5/136; 5/159.1; 5/166.1

(58) Field of Classification Search ..... 16/389, 16/390, 392; 5/159.1, 166.1, 2.1, 133, 136
See application file for complete search history.

(56) References Cited

U.S. PATENT DOCUMENTS

| | | | | | |
|---|---|---|---|---|---|
| 244,566 | A | * | 7/1881 | Doring | 5/2.1 |
| 307,013 | A | * | 10/1884 | Carleton | 5/53.2 |
| 379,449 | A | * | 3/1888 | Condell | 5/164.1 |
| 403,850 | A | * | 5/1889 | Merrill | 5/43 |
| 403,851 | A | * | 5/1889 | Merrill | 5/164.1 |
| 482,028 | A | * | 9/1892 | Teufel | 5/138 |
| 925,397 | A | | 6/1909 | Snyder | |
| 950,362 | A | * | 2/1910 | Anderson | 5/166.1 |
| 1,419,586 | A | * | 6/1922 | Plackard | 5/2.1 |
| 1,589,006 | A | | 6/1926 | Huddleston | |
| 1,633,423 | A | | 6/1927 | Talbott | |
| 2,172,605 | A | | 9/1939 | Bourn | |
| 2,447,480 | A | | 8/1948 | Stubbs | |
| 2,564,512 | A | * | 8/1951 | Specht | 5/2.1 |
| 2,671,230 | A | * | 3/1954 | Potter | 5/141 |
| 3,088,127 | A | * | 5/1963 | Eames | 5/2.1 |
| 3,097,369 | A | | 7/1963 | Emch | |
| 3,386,110 | A | | 6/1968 | Vanhentenrijk et al. | |
| 3,537,769 | A | | 11/1970 | Carlo | |
| 3,591,247 | A | * | 7/1971 | Berry et al. | 312/304 |
| 3,732,583 | A | | 5/1973 | Jones | |
| 3,913,973 | A | | 10/1975 | Mintz et al. | |
| 3,922,734 | A | | 12/1975 | Herrera | |
| 4,070,715 | A | | 1/1978 | Reppas | |
| 4,103,373 | A | * | 8/1978 | Luedtke et al. | 5/166.1 |
| 4,283,811 | A | * | 8/1981 | George | 16/390 |
| 4,318,145 | A | | 3/1982 | Frandsen | |
| 4,318,195 | A | | 3/1982 | Reppas | |

(Continued)

FOREIGN PATENT DOCUMENTS

| | | |
|---|---|---|
| CH | 659370 | 1/1987 |

(Continued)

OTHER PUBLICATIONS

Marianne Rohrlich, "Time to Stow Those Gags", Dec. 26, 2000, New York Times, Section B11.

*Primary Examiner*—Sunil Singh
(74) *Attorney, Agent, or Firm*—Harness, Dickey & Pierce, PLC

(57) ABSTRACT

A convertible furniture assembly having a bed frame pivotally coupled to a frame assembly. The bed frame is pivotally moveable between an upright position and a lowered position. A counterbalance member is coupled to the bed frame and adapted for counterbalancing the bed frame during movement, thereby minimizing the size of a corresponding torsion system. The present invention further includes a hinge assembly capable of providing a spacing distance between the bed frame and a lower platform.

33 Claims, 7 Drawing Sheets

U.S. PATENT DOCUMENTS

| | | | | | |
|---|---|---|---|---|---|
| 4,345,803 | A | | 8/1982 | Heck | |
| 4,476,592 | A | | 10/1984 | Reppas et al. | |
| 4,538,861 | A | | 9/1985 | Hughes, Jr. | |
| 4,597,568 | A | * | 7/1986 | Drexhage | 267/154 |
| 4,695,104 | A | | 9/1987 | Lederman | |
| 4,735,150 | A | | 4/1988 | Roberts | |
| 4,828,342 | A | | 5/1989 | Stefan | |
| 5,033,134 | A | * | 7/1991 | Burchett | 5/133 |
| 5,036,558 | A | | 8/1991 | Lameka et al. | |
| 5,101,523 | A | | 4/1992 | Bright | |
| 5,136,737 | A | | 8/1992 | Reppas et al. | |
| 5,199,773 | A | | 4/1993 | Price, Jr. et al. | |
| 5,205,631 | A | | 4/1993 | Wegman et al. | |
| 5,353,452 | A | | 10/1994 | Rulis | |
| 5,377,951 | A | | 1/1995 | Johnson et al. | |
| 5,621,930 | A | | 4/1997 | Reppas et al. | |
| 5,655,823 | A | | 8/1997 | Schairbaum | |
| 5,758,934 | A | | 6/1998 | Flutka et al. | |
| 5,806,248 | A | | 9/1998 | Kim | |
| 6,212,710 | B1 | * | 4/2001 | Jones | 5/118 |
| 6,401,276 | B1 | * | 6/2002 | Sherman | 5/136 |
| 6,508,526 | B1 | | 1/2003 | Reppas et al. | |
| 6,691,342 | B1 | * | 2/2004 | Sherman | 5/136 |

FOREIGN PATENT DOCUMENTS

| | | | |
|---|---|---|---|
| GB | 2172498 | | 9/1986 |
| JP | 53-32258 | * | 3/1978 |
| JP | 60-84618 | | 5/1985 |
| JP | 2000-197525 | | 7/2000 |
| WO | WO 93/25117 | | 12/1993 |

* cited by examiner

CONVERTIBLE FURNITURE

BACKGROUND AND SUMMARY OF THE INVENTION

The present invention relates generally to convertible furniture and, more particularly, relates to a convertible bed having wood dependent movements.

Convertible furniture has previously been provided as an expedient for saving floor space. For example, the well-known sofa bed provides a sofa in one mode and a bed frame and mattress in another mode. Other arrangements have been suggested to provide combination bed and table or desk furniture. For example, U.S. Pat. No. 4,070,715, issued to Reppas and the disclosure of which is incorporated herein, teaches a combination bed and desk furniture piece in which a bed frame and desk are mounted on a base for conjoint movement between raised and lowered positions. In the raised position, the bed frame is pivoted upright where its bedding is concealed from view and at the same time, the desk is elevated to a standard height above the floor. In the lowered position, the bed frame is pivoted to a horizontal orientation spaced above the top of the desk to provide clearance for small articles left on the desk surface. In this lowered position, the bed frame is lowered to standard bed height above the floor, which is lower than the desk. Means are provided for simultaneously moving the bed frame and desk between the raised and lowered positions without altering the horizontal alignment of the desk and its drawers with respect to the floor. This combination bed and desk furniture piece is particularly well suited for applications requiring efficient use of a space while providing a generally flat work surface.

In general, torsion systems are used with convertible furniture to store potential energy as the furniture components are lowered or stowed. The amount of potential energy stored in a torsion bar is a function of torsional stress. Torsional stress is defined by the amount of twist per unit length of the bar. These torsion systems are selected based on the weight of the unit, in this case the bed structure and/or desk assembly, to be lifted. Previous convertible furniture required that the torsion system solely supply the actuation and/or lifting energy to at least partially raise the bed structure. However, it should be appreciated that these torsion systems have a limited lifting capacity and, thus, it is advantageous to assist the torsion system by counter balancing the weight to be lifted so as to increase the lifting capacity of the system. Accordingly, with this increased lifting capacity, the size and/or number of torsion bars required may be reduced, which reduces the overall cost of the convertible furniture.

Thus, a need has been recognized for convertible furniture that is capable of minimizing the weight to be lifted and/or lifting capacity of the torsion system thereby permitting more elaborate furniture to be constructed without increasing the size of the torsion system. Accordingly, a first embodiment of the present invention provides convertible furniture that employs a slidable panel system capable of at least in part counterbalancing the weight of the bed structure. This arrangement reduces the overall weight the torsion system must lift.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
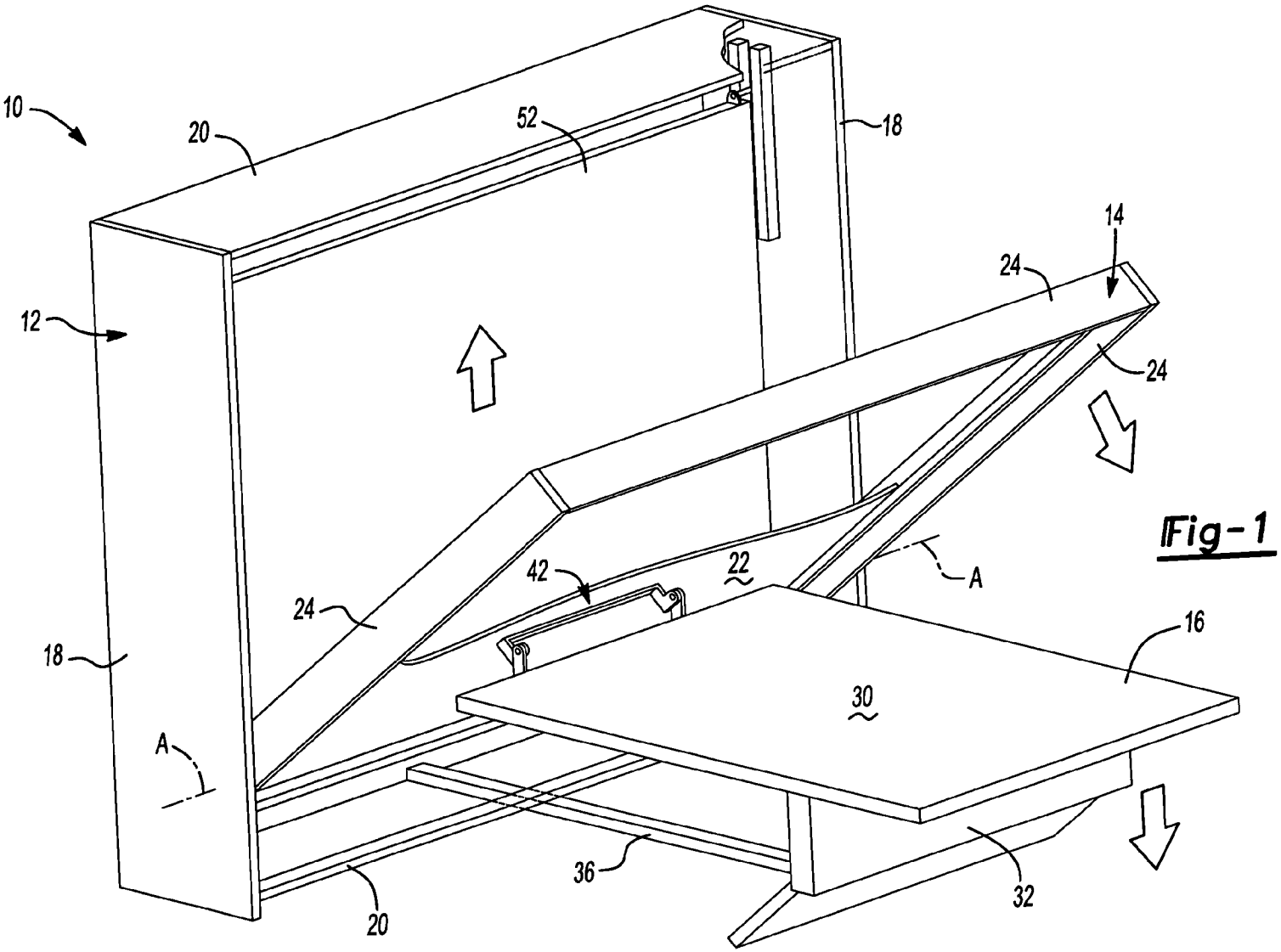
FIG. 1 is a perspective view illustrating a convertible furniture assembly according to the principles of the present invention with portions removed for clarity.
Figure 2:
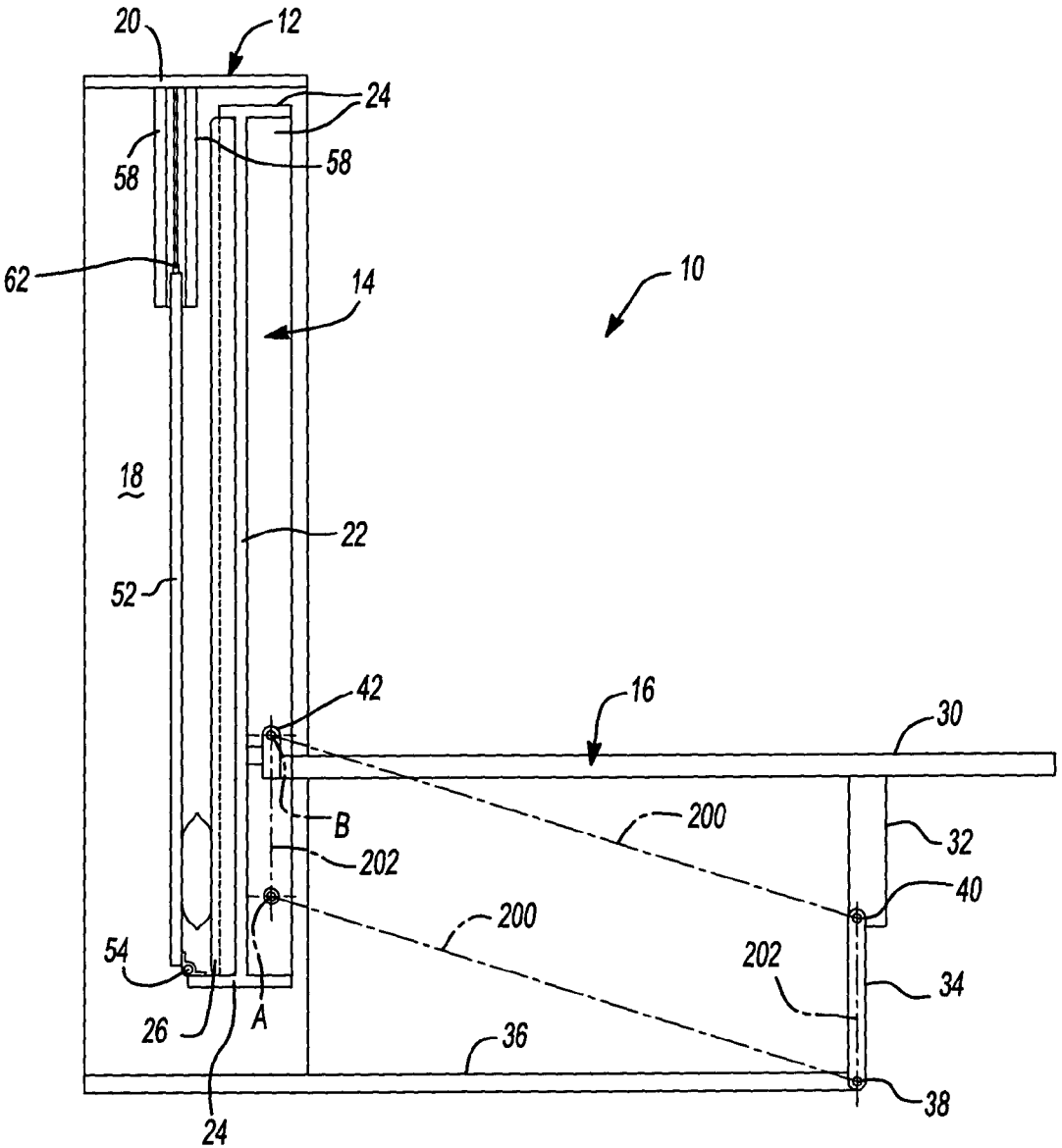
FIG. 2 is a side view showing the convertible furniture assembly in the raised position.
Figure 3:
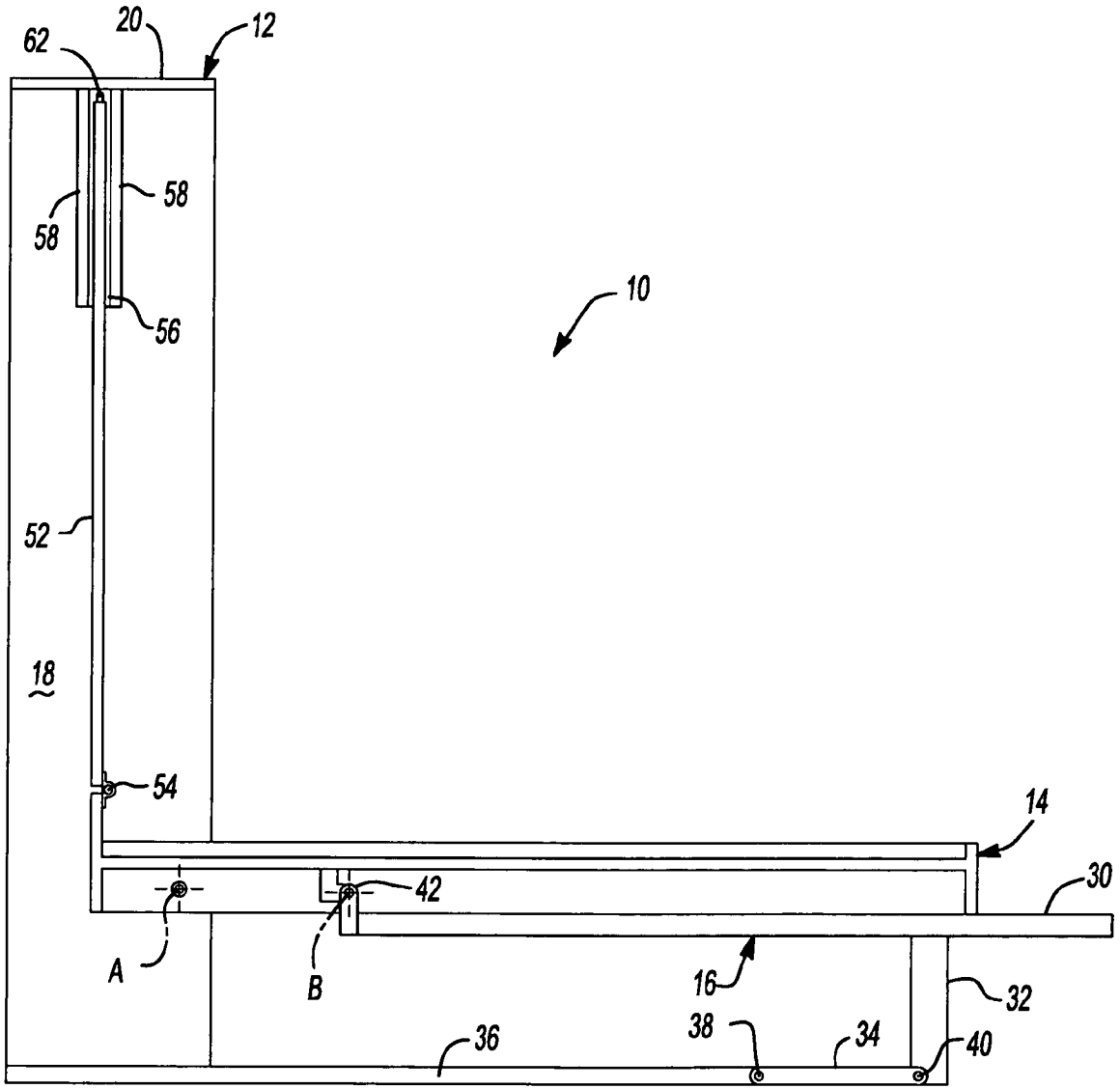
FIG. 3 is a side view showing the convertible furniture assembly in the lowered position.

Referring now to FIGS. 1–7, a combination convertible bed and table furniture piece according to the principles of the present invention, generally indicated at 10 in FIGS. 1–3, is provided. It should be appreciated that although various features of the present invention will be discussed in conjunction with particular embodiments, it should be understood that these various features may be combined in a number of combinations to create new and useful convertible bed and table furniture pieces. That is, the features of this invention can be used individually or in any combination. The use of any particular feature with a particular embodiment is for exemplary purposes only.

Still referring to FIGS. 1–7, furniture piece 10 includes a support frame or furniture frame assembly 12, which carries a bed frame 14 and a table assembly 16. It should be understood that the present invention will be described in connection with table assembly 16; however, the invention should not be regarded as being limited to having a table assembly since a sofa or desk assembly may also be used. Furniture frame assembly 12 is adapted for standing on a floor or other generally flat support surface and may be positioned so as to abut a wall, if desired. Furniture frame assembly 12 includes two upright laterally spaced sidewalls 18 joined along a horizontal support members 20.

As best seen in FIGS. 1–3, bed frame 14 includes a bottom wall 22 (with portions removed for clarity in FIG. 1) and four sidewalls 24 that define an open rectangular enclosure for holding bedding 26. Bed frame 14 is pivotally coupled to furniture frame assembly 12 about a pivot axis A—A. The pivoting movement of bed frame 14 relative to furniture frame assembly 12 is most completely described in U.S. Pat. Nos. 4,476,592, 5,136,737, 5,621,930, and 6,508,526, each issued to Reppas et al. and the disclosures of which are incorporated herein. Particular reference should be made to the '737 patent with regard to the torsion system for use in aiding the raising of the bed portion from the lowered position to the raised position.

Table assembly 16 of furniture piece 10 is oriented such that its longitudinal axis extends generally perpendicular to pivot axis A. Similarly, bed frame 14 of furniture piece 10 is oriented such that its longitudinal axis extends generally perpendicular to pivot axis A. This arrangement enables the length of table assembly 16 to be maximized due to the length of bed frame 14.

Table assembly 16 includes a generally flat, horizontally disposed desktop or tabletop 30, which provides a continuous writing or serving surface. Table assembly 16 further includes a leg member 32 fixedly mounted and downwardly extending from tabletop 30.

Furniture piece 10 further includes a self-standing support 34 pivotally interconnected between an outrigger support member 36 and leg member 32 of table assembly 16. Self-standing support 34 facilitates the raising and lowering of table assembly 16. Specifically, self-standing support 34 is pivotally coupled at one end to outrigger support member 36 at pivot 38 and pivotally coupled at the other end to leg member 32 of table assembly 16 at pivot 40. Outrigger support member 36 is fixed mounted to furniture frame assembly 12 and forms part of furniture frame assembly 12.

Figure 4:
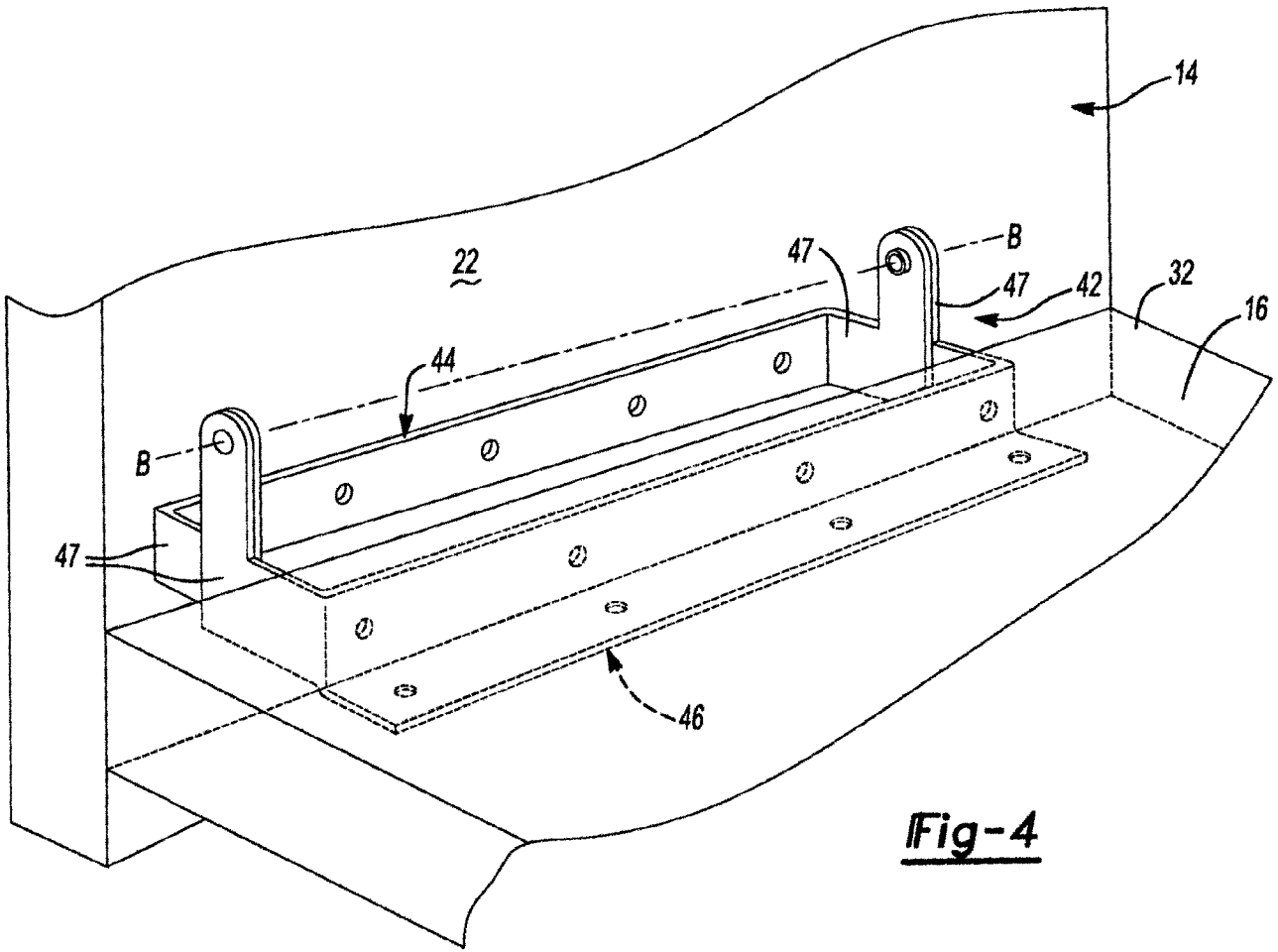
FIG. 4 is an enlarged perspective view showing a hinge assembly according to the principles of the present invention with a bed frame in a raised position with portions removed for clarity.
Figure 5:
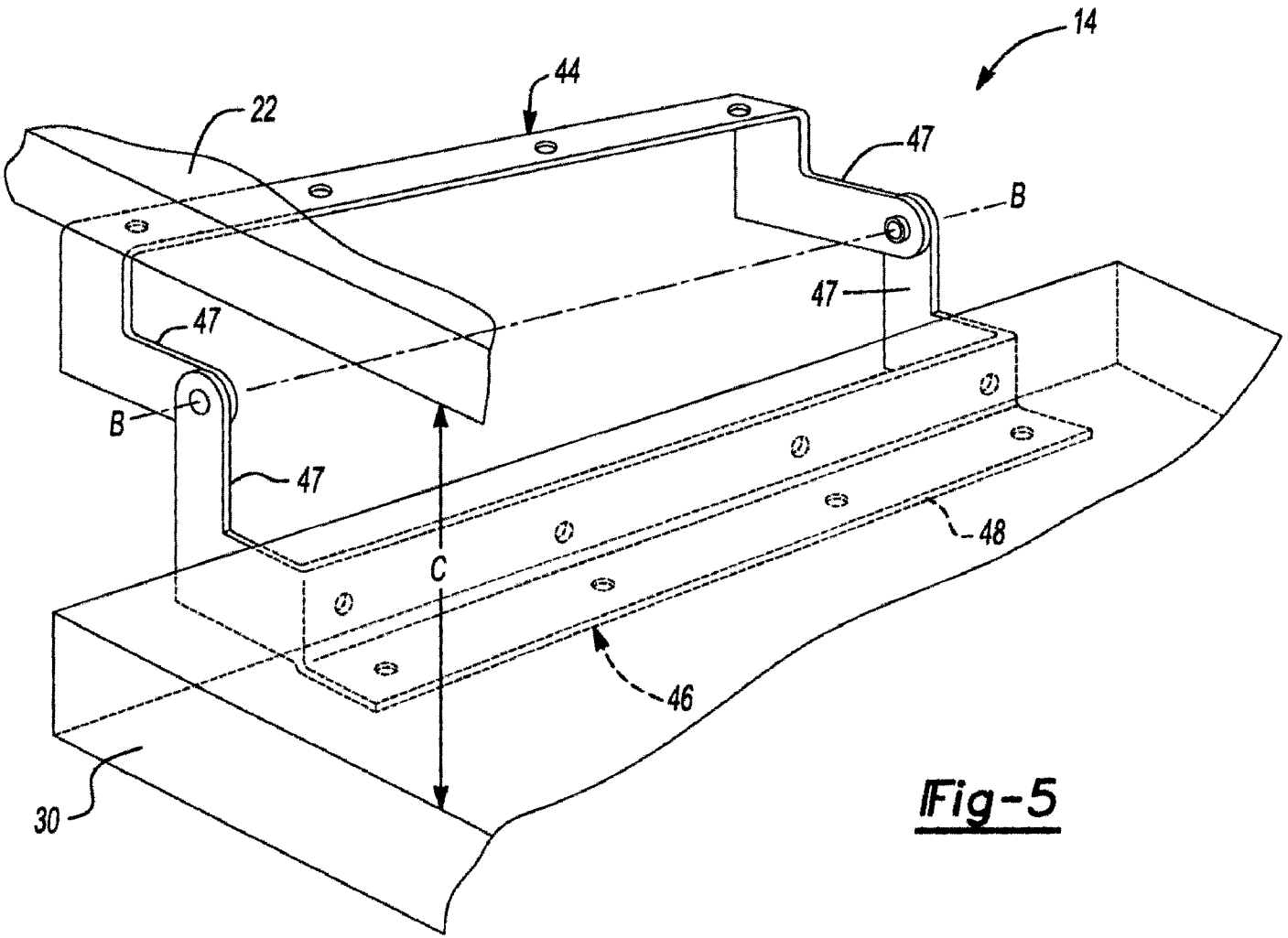
FIG. 5 is an enlarged perspective view showing the hinge assembly according to the principles of the present invention with the bed frame in a lowered position with portions removed for clarity.
Figure 6:
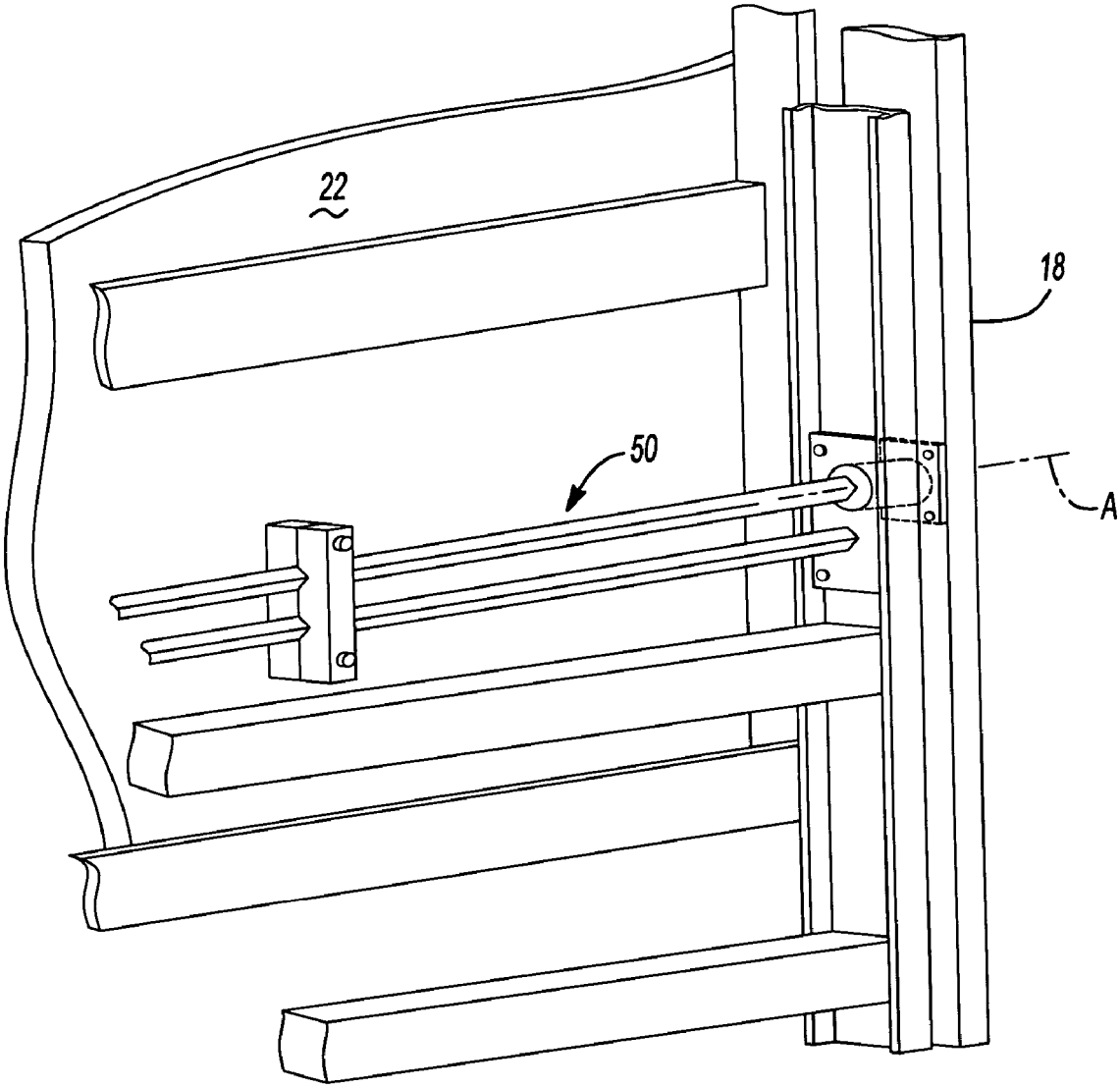
FIG. 6 is a perspective view showing the torsion system of the present invention.

As best seen in FIGS. 4 and 5, table assembly 16 is pivotally coupled to bed frame 14 via a hinge assembly 42. Hinge assembly 42 includes a first hinge portion 44 fixedly mounted to bottom wall 22 of bed frame 14. Additionally, hinge assembly 42 includes a second hinge portion 46 fixedly mounted to tabletop 30 of table assembly 16. Second hinge portion 46 includes a mounting bracket portion 48 to facilitate fixedly mounting and supporting tabletop 30 thereon. First hinge portion 44 and second hinge portion 46 each include a pair of L-shaped or doglegged ends 47 that are pivotally coupled along a pivot axis B—B. The particular shape of hinge assembly 42 in the present embodiment permits bed frame 14 to pivot relative to table assembly 16 to define a spacing distance C between the top of tabletop 30 and the bottom of bottom wall 22. This spacing distance permits items to be left upon the top of tabletop 30 even when bed frame 14 is in a lowered position (FIG. 3). Preferably, this spacing distance is about 2 inches; however, any distance may be chosen that facilitates producing a desired spacing distance. It should be recognized, however, that the particular shape of hinge assembly 42 may be modified as needed and need not be identical to that shown in the exemplary figures. Although hinges that provide this desired spacing distance are regarded as being within the scope of this invention.

Bed frame 14, table assembly 16, self-standing support 34, outrigger support member 36, and furniture frame assembly 12 define a parallelogram linkage geometry that maintains a horizontal attitude of table assembly 16 as furniture piece 10 is converted between a bed mode and a table mode. More specifically, the parallelogram linkage geometry is defined by a first pair of linkages 200 (schematically illustrated in phantom in FIG. 2, extending between axis B and pivot 40, and axis A and pivot 38, respectively) and a second pair of linkages 202 (schematically illustrated in phantom in FIG. 2, extending between axis A and axis B, and pivot 38 and pivot 40, respectively). Such arrangement enables table assembly 16 to be raised and lowered relative to the floor as bed frame 14 is pivoted about pivot axis A. A four-bar torsion system 50 (FIG. 1) stores potential energy as bed frame 14 is lowered to aid in the raising of bed frame 14 when such movement is desired. It should be appreciated that second pair of linkages 202 are slightly tilted to the left in the figures to form an overcenter condition that aids in maintaining bed frame 14 in its raised position.

As best seen in FIGS. 1–3 and 7, furniture piece 10 further includes a counterbalance panel 52 pivotally coupled to sidewall 24 of bed frame 14 at pivot 54. Counterbalance panel 52 is slidably received within a guide channel 56 formed in or attached to furniture frame assembly 12. Specifically, guide channel 56 may be formed according to a plurality of designs, such as using a pair of strips 58 mounted to sidewalls 18 of furniture frame assembly 12, using a pair of panels (not shown) extending along the top to conceal a gap between a top 60 of counterbalance panel 52 and horizontal support member 20, or otherwise forming a groove or slotted track in sidewalls 18 of furniture frame assembly 12. According to the present embodiment, counterbalance panel 52 includes a guide pin 62 extending therefrom and disposed within guide channel 56 to retaining and guide counterbalance panel 52 upward and downward as furniture piece 10 is converted between the bed mode and the table mode.

Counterbalance panel 52 is provided as a counterbalancing weight to offset the weight of bed frame 14 and bedding 26 pivoting about axis A—A. In other words, as bed frame 14 is lowered from the table mode to the bed mode, counterbalance panel 52 is forced upward, thereby storing potential energy in the form of an elevated member. As bed frame 14 is raised from the bed mode to the table mode, the potential energy stored in raising counterbalance panel 52 is now released to help raise bed frame 14. In this regard, counterbalance panel 52 aids torsion system 50 in the raising of bed frame 14 and, thus, minimizes the amount of work required by torsion system 50. By minimizing the amount of work required by torsion system 50 it is possible to minimize the lifting capacity and size of torsion system 50, thereby increasing the useable size of bed frame 14 (or sofa or desk assembly) and/or reducing the cost associated therewith.

It should be understood that counterbalance panel 52 also functions as a simple and convenient headboard for concealing the wall and any associated furniture structure located there behind. However, in an attempt to facilitate simple and convenient access to the back of convertible furniture piece 10 for maintenance and/or repair, it is preferable that guide pins 62 be retractable or at least disengagable from corresponding guide channel 56. In this regard, counterbalance panel 52 may be pivoted forward onto bed frame 14 to expose the back portion of convertible furniture piece 10 without the need to move convertible furniture piece 10 away from the wall.

In operation, furniture piece 10 is converted from the table mode to the bed mode according to the following operation (FIGS. 1–3). Bed frame 14 is first lowered into the bed mode automatically or manually. Particular reference should be made to the aforementioned '195 patent for a discussion of a motorized lowering mechanism. According to a manual operation, bed frame 14 is pivoted downward and, thus, caused to pivot about pivot axis A—A. The pivoting motion of bed frame 14 acts upon table assembly 16 through hinge assembly 42 along pivot axis B—B, thereby causing a pivoting movement of table assembly 16 about pivots 38, 40 of self-standing support 34. This pivoting movement of table assembly 16 about pivots 38, 40 maintains table assembly 16 in a generally horizontal orientation and further causes counterbalance panel 52 to be raised upwardly against the weight of bed frame 14. This movement of bed frame 14, table assembly 16, and counterbalance panel 52 continues until leg member 32 of table assembly 16 is positioned generally upon the floor or other flat surface and bed frame 14 is generally positioned on top of table assembly 16. In this position, counterbalance panel 52 is in its raised position. An opposite method is employed to convert furniture piece 10 from the bed mode to the table mode.

Figure 7:
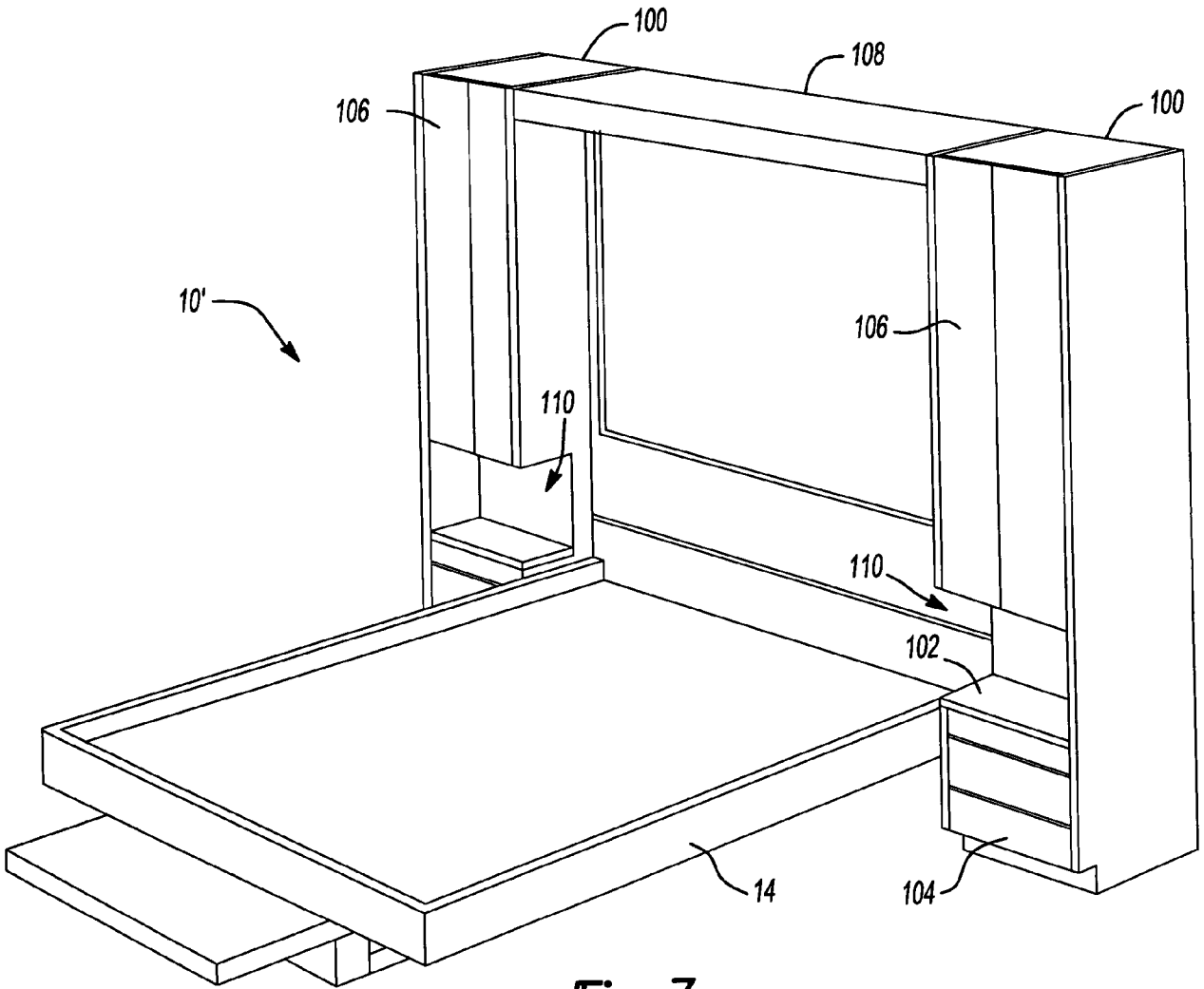
FIG. 7 is a perspective view illustrating a convertible furniture assembly according to another embodiment of the present invention with portions removed for clarity.

Referring now to FIG. 7, convertible furniture piece 10' may further include an optional pair of cabinets 100 disposed on opposing sides of furniture frame assembly 12. Alternatively, it is anticipated that the pair of cabinets 100 could be used to replace furniture frame assembly 12, as shown. Each of the pair of cabinets 100 includes a table surface 102 that is accessible through a cutout section 110 of the side panels. As should be appreciated, conventional tables positioned to the side of the aforedescribed furniture piece 10 would be obstructed by furniture frame assembly 12. Therefore, by incorporating the pair of cabinets 100 into the structure of furniture piece 10, such pair of cabinets 100 can carrying any associated operating loads while further enabling table surfaces 102 to be used unobstructedly. Drawers 104 are disposed below table surface 102, and cabinets 106 disposed above table surface 102. Each of the pair of cabinets 100 may further include adjustable lighting for reading in bed and/or disposed above table surface 102. Lastly, a cross member 108 may be used to retain cabinets 100 adjacent convertible furniture piece 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A convertible furniture assembly comprising:

a frame assembly;

an upper platform pivotally coupled to said frame assembly for supporting a bedding component, said upper platform being moveable between a raised position and a lowered position; and a headboard member coupled to said upper platform, said headboard member being raised solely vertically between a first position and a second position in response to said upper platform moving from said raised position to said lowered position to counterbalance said upper platform and to oppose movement of said upper platform from said raised position to said lowered position;

a guide assembly positioned between said frame assembly and said headboard member, said guide assembly operable to guide said headboard member between said first position an said second position, said guide assembly having a guide channel extending along one of said headboard member and said frame assembly; and a guide pin extending from the other of said headboard member and said frame assembly, said guide pin being sized to be slidably received within said guide channel;

a lower platform;

a first hinge portion fixedly coupled to an underside of said upper platform; and a second hinge portion fixedly coupled to said lower platform, said second hinge portion being pivotally coupled to said first hinge portion along an axis, said axis being offset from at least one of said upper platform and said lower platform so as to define a spacing distance between said upper platform and said lower platform.

2. The convertible furniture assembly according to claim 1 wherein said spacing distance is sufficient to accommodate items positioned on top of said lower platform.

3. The convertible furniture assembly according to claim 1 wherein at least one of said first hinge portion and said second hinge portion is generally L-shaped.

4. The convertible furniture assembly according to claim 1 further comprising:

a self-standing support pivotally coupled between said frame assembly and said lower platform, said upper platform being pivotally coupled with said lower platform in parallelogram linkage geometry with said self-standing support and said frame assembly for maintaining a horizontal orientation of said lower platform throughout the raising and lowering of said upper platform.

5. The convertible furniture assembly according to claim 1 wherein said lower platform is a table.

6. The convertible furniture assembly according to claim 1 wherein said headboard member is pivotally coupled to said upper platform.

7. The convertible furniture assembly according to claim 1 wherein said headboard member conceals an area behind said frame assembly.

8. The convertible furniture assembly according to claim 1 wherein said upper platform is a bed frame.

9. The convertible furniture assembly according to claim 1, further comprising:

a cabinet positioned adjacent said frame assembly.

10. The convertible furniture assembly according to claim 1, further comprising:

a cabinet formed integrally with said frame assembly.

11. A convertible furniture assembly comprising:

a frame assembly;

an upper platform pivotally coupled to said frame assembly for supporting a bedding component, said upper platform being moveable between a raised position and a lowered position; and a counterbalance member coupled to said upper platform, said counterbalance member being raised between a first position and a second position in response to said upper platform moving from said raised position to said lowered position;

a lower platform;

a first hinge portion fixedly coupled to an underside of said upper platform;

a second hinge portion fixedly coupled to said lower platform, said second hinge portion being pivotally coupled to said first hinge portion along an axis, said axis being offset from at least one of said upper platform and said lower platform so as to define a spacing distance between said upper platform and said lower platform;

a guide assembly positioned between said frame assembly and said counterbalance member, said guide assembly operable to guide said counterbalance member between said first position and said second position, said guide assembly comprises:

a guide channel extending along one of said counterbalance member and said frame assembly; and a guide pin extending from the other of said counterbalance member and said frame assembly, said guide pin being sized to be slidably received within said guide channel, wherein said guide pin is removable from said guide channel.

12. A convertible furniture assembly comprising:

a frame assembly;

an upper platform pivotally coupled to said frame assembly for supporting a bedding component, said upper platform being moveable between a raised position and a lowered position;

a headboard member coupled to said upper platform, said headboard member being raised solely vertically between a first position and a second position in response to said upper platform moving from said raised position to said lowered position to counterbalance said upper platform and to oppose movement of said upper platform from said raised position to said lowered position;

a guide assembly positioned between said frame assembly and said headboard member, said guide assembly having a guide channel extending along one of said headboard member and said frame assembly and a guide pin extending from the other of said headboard member and said frame assembly, said guide pin being sized to be slidably received within said guide channel; and a torsion system providing torsional energy to aid in moving said upper platform between said lowered position and said raised position, said torsion system operably coupled between said frame assembly and said upper platform.

13. The convertible furniture assembly according to claim 12 wherein said headboard member is operable to provide energy to supplement said energy from said torsion system.

14. A convertible furniture assembly comprising:

a frame assembly having a vertically extending side member;

an upper platform pivotally coupled to said frame assembly for supporting a bedding component, said upper platform being moveable between a raised position and a lowered position;

a headboard member coupled to said upper platform, said headboard member being raised solely vertically between a first position and a second position in response to said upper platform moving from said raised position to said lowered position to counterbalance said upper platform and to oppose movement of said upper platform from said raised position to said lowered position;

a guide assembly positioned between said frame assembly and said headboard member, said guide assembly having a guide channel extending along one of said headboard member and said frame assembly and a guide pin extending from the other of said headboard member and said frame assembly, said guide pin being sized to be slidably received within said guide channel;

a torsion system providing torsional energy to aid in moving said upper platform between said lowered position and said raised position, said torsion system operably coupled between said frame assembly and said upper platform;

a cabinet formed integrally with said frame assembly;

a table surface positioned adjacent said upper platform; and a cutout formed in said side member of said frame assembly to permit access to said entire table surface from said upper platform.

15. A convertible furniture assembly comprising:

a base assembly;

an first platform pivotally coupled to said base assembly for supporting a bedding component, said first platform being moveable between a raised position and a lowered position;

a headboard coupled to said first platform, said headboard being raised solely vertically, between a first position and a second position in response to said first platform moving from said raised position to said lowered position to counterbalance said first platform and to oppose movement of said first platform from said raised position to said lowered position;

a second platform;

a first hinge portion fixedly coupled to an underside of said first platform;

a second hinge portion fixedly coupled to said second platform, said second hinge portion being pivotally coupled to said first hinge portion along an axis, said axis being offset from at least one of said first platform and said second platform so as to define a spacing distance between said first platform and said second platform; and a guide assembly positioned between said base assembly and headboard, said guide assembly having a guide channel extending along one of said headboard and said base assembly and a guide pin extending from the other of said headboard and said base assembly, said guide pin being sized to be slidably received within said guide channel.

16. The convertible furniture assembly according to claim 15 wherein said guide pin is removable from said guide channel.

17. The convertible furniture assembly according to claim 15 wherein said headboard is operable to provide an opposing force as said first platform moves from said raised position to said lowered position.

18. The convertible furniture assembly according to claim 17 wherein said opposing force is generated at least in part by gravity.

19. The convertible furniture assembly according to claim 17 wherein said headboard is pivotally coupled to said first platform.

20. The convertible furniture assembly according to claim 15 wherein said spacing distance is sufficient to accommodate items positioned on top of said second platform.

21. The convertible furniture assembly according to claim 15 wherein at least one of said first hinge portion and said second hinge portion is generally L-shaped.

22. The convertible furniture assembly according to claim 15 further comprising:

a self-standing support pivotally coupled between said base assembly and said second platform, said first platform being pivotally coupled with said second platform in parallelogram linkage geometry with said self-standing support and said base assembly for maintaining a horizontal orientation of said second platform throughout the raising and lowering of said first platform.

23. The convertible furniture assembly according to claim 15 wherein said second platform is a table.

24. The convertible furniture assembly according to claim 15 wherein said first platform is a bed frame.

25. A convertible furniture assembly comprising:

a frame assembly;

an upper platform pivotally coupled to said frame assembly for supporting a bedding component, said upper platform being moveable between a raised position and a lowered position;

a headboard member pivotally coupled to said upper platform, said headboard member being raised solely vertically between a first position and a second position in response to said upper platform moving from said raised position to said lowered position to counterbalance said upper platform and to oppose movement of said upper platform from said raised position to said lowered position;

a guide assembly positioned between said frame assembly and said headboard member, said guide assembly operable to guide said headboard member between said first position and said second position, said guide assembly having a guide channel extending along one of said headboard member and said frame assembly; and a guide pin extending from the other of said headboard member and said frame assembly, said guide pin being sized to be slidably received within said guide channel;

a lower platform;

a first hinge portion fixedly coupled to an underside of said upper platform; and a second hinge portion fixedly coupled to said lower platform, said second hinge portion being pivotally coupled to said first hinge portion along an axis, said axis being offset from at least one of said upper platform and said lower platform so as to define a spacing distance between said upper platform and said lower platform.

26. The convertible furniture assembly according to claim 25 wherein said guide pin is removable from said guide channel.

27. The convertible furniture assembly according to claim 25 wherein said spacing distance is sufficient to accommodate items positioned on top of said lower platform.

28. The convertible furniture assembly according to claim 25 wherein at least one of said first hinge portion and said second hinge portion is generally L-shaped.

29. The convertible furniture assembly according to claim 25, further comprising:

a self-standing support pivotally coupled between said frame assembly and said lower platform, said upper platform being pivotally coupled with said lower platform in parallelogram linkage geometry with said self-standing support and said frame assembly for maintaining a horizontal orientation of said lower platform throughout the raising and lowering of said upper platform.

30. The convertible furniture assembly according to claim 25 wherein said headboard member is operable to provide an opposing force as said upper platform moves from said raised position to said lowered position.

31. The convertible furniture assembly according to claim 30 wherein said opposing force is generated at least in part by gravity.

32. The convertible furniture assembly according to claim 25, further comprising:

a torsion system providing energy to aid in moving said upper platform between said lowered position and said raised position, said torsion system operably coupled between said frame assembly and said upper platform.

33. The convertible furniture assembly according to claim 32 wherein said headboard member is operable to provide energy to supplement said energy from said torsion system.

* * * * *